US005565886A

United States Patent [19]

Gibson

[11] Patent Number: 5,565,886

[45] Date of Patent: Oct. 15, 1996

[54] METHOD AND SYSTEM FOR RAPIDLY TRANSMITTING MULTICOLOR OR GRAY SCALE DISPLAY DATA HAVING MULTIPLE BITS PER PIXEL TO A DISPLAY DEVICE

[75] Inventor: Michael S. Gibson, Redmond, Wash.

[73] Assignee: Microsoft Corporation, Redmond, Wash.

[21] Appl. No.: 146,413

[22] Filed: Nov. 1, 1993

[51] Int. Cl.[6] ..... G09G 5/36

[52] U.S. Cl. ..... 345/136; 345/147; 345/150; 345/141; 345/187

[58] Field of Search ..... 345/141, 142, 345/143, 144, 150, 152, 189, 186, 187, 192, 193, 194, 195, 199, 136, 137, 138, 147

[56] References Cited

U.S. PATENT DOCUMENTS

| | | | |
|---|---|---|---|
| 4,486,785 | 12/1984 | Lasher et al. | 345/136 |
| 5,146,346 | 9/1992 | Knoll | 358/298 |
| 5,334,996 | 8/1994 | Tanigaki et al. | 345/136 |

OTHER PUBLICATIONS

Jackie Neider, Tom Davis, and Mason Woo, "OpenGL Programming Guide–The Official Guide to Learning OpenGL, Release 1", pp. 393–395 (1993).

*Primary Examiner*—Richard Hjerpe
*Assistant Examiner*—Xiao M. Wu
*Attorney, Agent, or Firm*—Seed and Berry LLP

[57] ABSTRACT

A method and system for rapidly transmitting multicolor or gray scale display data having multiple bits per pixel to a display device is provided. In a preferred embodiment, the method and system constitutes a software facility. The facility first encodes the image into multiple bit per pixel raster data. The multiple bit per pixel raster data has a number of pixels. Each pixel stores a color value corresponding to the color of a particular region within the image. The facility then associates one or more single bit per pixel raster planes with the multiple bit per pixel raster data. Each single bit per pixel raster plane corresponds to a color value that appears in the multiple bit per pixel raster data. Each pixel of each single bit per pixel raster plane corresponds to a pixel of the multiple bit per pixel raster data, and indicates whether the corresponding pixel in the multiple bit per pixel raster data contains the color value of the single bit per pixel raster plane. The facility then transmits the associated single bit per pixel raster planes to the display device. Each single bit per pixel raster plane is accompanied by one or more instructions to draw the single bit per pixel raster plane in the corresponding color value.

12 Claims, 16 Drawing Sheets

| | A | B | C | D | E | F | G | H |
|---|---|---|---|---|---|---|---|---|
| 1 | 0 | 0 | 0 | 0 | 1 | 0 | 0 | 0 |
| 2 | 0 | 0 | 0 | 0 | 1 | 0 | 0 | 0 |
| 3 | 0 | 0 | 0 | 1 | 1 | 1 | 0 | 0 |
| 4 | 0 | 0 | 0 | 1 | 0 | 1 | 0 | 0 |
| 5 | 0 | 0 | 0 | 1 | 0 | 1 | 0 | 0 |
| 6 | 0 | 0 | 1 | 1 | 1 | 1 | 1 | 0 |
| 7 | 0 | 0 | 1 | 0 | 0 | 0 | 1 | 0 |
| 8 | 0 | 1 | 1 | 0 | 0 | 0 | 1 | 1 |
| 9 | 0 | 1 | 0 | 0 | 0 | 0 | 0 | 1 |

PRIOR ART

*Fig. 1A*

| | A | B | C | D | E | F | G | H |
|---|---|---|---|---|---|---|---|---|
| 1 | 0 | 0 | 0 | 0 | 1 | 0 | 0 | 0 |
| 2 | 0 | 0 | 0 | 0 | 3 | 0 | 0 | 0 |
| 3 | 0 | 0 | 0 | 1 | 3 | 1 | 0 | 0 |
| 4 | 0 | 0 | 0 | 2 | 0 | 2 | 0 | 0 |
| 5 | 0 | 0 | 0 | 2 | 0 | 2 | 0 | 0 |
| 6 | 0 | 0 | 1 | 3 | 3 | 3 | 1 | 0 |
| 7 | 0 | 0 | 3 | 0 | 0 | 0 | 3 | 0 |
| 8 | 0 | 1 | 1 | 0 | 0 | 0 | 1 | 1 |
| 9 | 0 | 2 | 0 | 0 | 0 | 0 | 0 | 2 |

PRIOR ART

*Fig. 2B*

| | | | | | | | |
|---|---|---|---|---|---|---|---|
| 0 | 0 | 0 | 0 | 1 | 0 | 0 | 0 |
| 0 | 0 | 0 | 0 | 3 | 0 | 0 | 0 |
| 0 | 0 | 0 | 1 | 3 | 1 | 0 | 0 |
| 0 | 0 | 0 | 2 | 0 | 2 | 0 | 0 |
| 0 | 0 | 0 | 2 | 0 | 2 | 0 | 0 |
| 0 | 0 | 1 | 3 | 3 | 3 | 1 | 0 |
| 0 | 0 | 3 | 0 | 0 | 0 | 3 | 0 |
| 0 | 1 | 1 | 0 | 0 | 0 | 1 | 1 |
| 0 | 2 | 0 | 0 | 0 | 0 | 0 | 2 |

FIG. 6

| 0x000000 | | | | | | | |
|---|---|---|---|---|---|---|---|
| 0 | 0 | 0 | 0 | 0 | 0 | 0 | 0 |
| 0 | 0 | 0 | 0 | 1 | 0 | 0 | 0 |
| 0 | 0 | 0 | 0 | 1 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 1 | 1 | 1 | 0 | 0 |
| 0 | 0 | 1 | 0 | 0 | 0 | 1 | 0 |
| 0 | 0 | 0 | 0 | 0 | 0 | 0 | 0 |
| 0 | 0 | 0 | 0 | 0 | 0 | 0 | 0 |

FIG. 10A

| 0x404040 | | | | | | | |
|---|---|---|---|---|---|---|---|
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 1 | 0 | 1 | 0 | 0 |
| 0 | 0 | 0 | 1 | 0 | 1 | 0 | 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 0 |
| 0 | 1 | 0 | 0 | 0 | 0 | 0 | 1 |

FIG. 10B

| 0xA0A0A0 | | | | | | | |
|---|---|---|---|---|---|---|---|
| 0 | 0 | 0 | 0 | 1 | 0 | 0 | 0 |
| 0 | 0 | 0 | 0 | 0 | 0 | 0 | 0 |
| 0 | 0 | 0 | 1 | 0 | 1 | 0 | 0 |
| 0 | 0 | 0 | 0 | 0 | 0 | 0 | 0 |
| 0 | 0 | 0 | 0 | 0 | 0 | 0 | 0 |
| 0 | 0 | 1 | 0 | 0 | 0 | 1 | 0 |
| 0 | 0 | 0 | 0 | 0 | 0 | 0 | 0 |
| 0 | 1 | 1 | 0 | 0 | 0 | 1 | 1 |
| 0 | 0 | 0 | 0 | 0 | 0 | 0 | 0 |

FIG. 10C

| initial color value (0 - 3) | display color value (0x000000 - 0xFFFFFF) |
|---|---|
| 3 | 0X000000 |
| 2 | 0X404040 |
| 1 | 0XA0A0A0 |

*Fig. 8*

METHOD AND SYSTEM FOR RAPIDLY TRANSMITTING MULTICOLOR OR GRAY SCALE DISPLAY DATA HAVING MULTIPLE BITS PER PIXEL TO A DISPLAY DEVICE

TECHNICAL FIELD

The invention relates generally to a method and system for transmitting display data to display devices, and, more specifically, to a method and system for rapidly transmitting multicolor or gray scale display data having multiple bits per pixel to display devices.

BACKGROUND OF THE INVENTION

A typical computer displays a character or other graphical object by transmitting a conventional bitmap for the graphical object to a display device. A conventional bitmap contains a single bit value for each pixel in the video display that is to be used in drawing the graphical object. Usually, if the bit contains a one, the pixel is set to a foreground color. If the bit is a zero, and the bitmap is being displayed in an opaque mode, the pixel is set to a background color. If the bit is a zero, and the bitmap is being displayed in a transparent mode, the color of the pixel is not changed.

FIG. 1A is a diagram that shows a conventional character bitmap for the character "A". The bitmap contains pixel values for 72 pixels required to display the character "A". A pixel is referenced by its column letter (A–H) and its row number (1–9). Pixel values H8 and H9 each contain a one which will cause the corresponding pixels to be set to a foreground color when the bitmap is displayed. Pixel value G9 contains a zero which will cause the corresponding pixel to be set to a background color when the bitmap is being displayed in opaque mode or not changed when the bitmap is displayed in transparent mode.

Bitmaps are more easily understood when presented as a display grid. A display grid is a representation of a bitmap in which each pixel value is portrayed by the shade of a block. A block is referenced by its column letter (A–H) and its row number (1–9). FIG. 1B is a display grid for the bitmap shown in FIG. 1A. It contains blocks like blocks H8 and H9 that are shaded because their corresponding pixel values are 1. The display grid also contains blocks like block G9 (i.e., column G, row 9) that are unshaded because their pixel values are zero.

A computer can generate a conventional bitmap from a character outline, which is comprised of straight lines and curves that form the shape of the outline of the character. Each straight line or curve is stored as a mathematical representation in an arbitrary coordinate system. For example, a straight line may be represented by the coordinates of its end points, while curves may be represented as an arc of an ellipse. FIGS. 1C–D are diagrams that show a character outline for the character "A". This particular character outline has straight lines 100, 101, 102, 103, 104, 105, 106, 107, 108 and 109 and no curves. The straight lines define three members 110, 111 and 112—regions bounded by the straight lines that are roughly rectangular. The conventional character bitmap of FIG. 1A can be generated from the character outline of FIG. 1C by first setting all of the bits of the bitmap to zero, then changing to one the bit of each pixel whose center falls inside the character outline. For example, the center 120 of pixel 121 falls within the character outline and thus pixel value H9 is set to 1. On the other hand, the center 122 of pixel 123 falls outside the character outline and therefore pixel value G9 is set to zero.

As can be noted from FIG. 1B, the edges of conventional character bitmaps often appear jagged. FIG. 1E is a superimposition of a character outline over the display grid. As can be seen from FIG. 1E, the jaggedness occurs because comers of some of the pixels that are set to one protrude well beyond the character outline. In the figure this is particularly true of pixels B8, C6, C8, D3, E1, F3, G6, GS, and H8. This effect is particularly pronounced for characters having diagonal members (such as italic characters), as well as for characters that are displayed using relatively few pixels. In order to address this jaggedness, a few computer systems use antialiased character bitmaps. An antialiased character bitmap, like conventional bitmaps, contains a value for each pixel in the video display that is to be used in drawing the graphical object that it represents. Antialiased characters are sometimes stored in a group, collectively called a font. Fonts can contain characters and other font elements, such as symbols. Unlike a conventional bitmap, an antialiased character bitmap represents the graphical object in more than one level of illuminative intensity. This allows pixels that extend outside of the character outline to be dimmed to a lower level of illuminative intensity, so that the fact that they extend outside of the character outline becomes less noticeable. Typically, a small number of illuminative intensities, such as four, is sufficient.

FIG. 2A is a diagram that shows a display grid for an antialiased character bitmap for the character "A". Displaying antialiased characters requires a display device capable of varying the illuminative intensity of each pixel. A pixel is referenced by its column letter (A–H), its row number (1–9) and a prime sign (').  Because they extend well beyond the character outline, pixels B8', C6', C8', D3', E1', F3', G6', G8', and H8' have been dimmed to a low level of illuminative intensity. This is shown in FIG. 2A by the low density hashing of these blocks. Because pixels B9', D4', D5', F4', F5', and H9' extend beyond the character outline to a lesser extent, they have been dimmed to a medium level of illuminative intensity. This is shown in the figure by medium density hashing of these blocks. Because pixels C7', D6', E2', E3', E6', F6', and G7' are substantially completely within the character outline, they remain at full illuminative intensity. This is shown in the figure by high density shading of these blocks.

Antialiased characters also require bitmaps that reflect different levels of illuminative intensity of each pixel other than "on" or "off". These bitmaps are known as multiple bit per pixel bitmaps, and use more that one bit to store the level of illuminative intensity of each pixel. In many cases, two bits per pixel are used. FIG. 2B is a multiple bit per pixel bitmap for the antialiased character shown in the display grid of FIG. 2A. The multiple bit per pixel bitmap stores a multiple bit pixel value (shown in base 10 in FIG. 2B) for each pixel A1'–H9'. Because pixel G9' falls outside the character outline, its pixel value is zero. Because pixel H8' extends well beyond the character outline, its pixel value is 1. Because pixel H9' extends beyond the character outline to a lesser extent, its pixel value is 2.

Antialiased characters can be very effective to reduce the jagged appearance of displayed text. However, displaying antialiased character bitmaps requires prohibitive levels of processing time, storage, and data traffic between the computer and the display device. Most display devices capable of displaying pixels at the small handful of different illuminative intensities required for antialiased characters are further capable of displaying pixels at thousands of different colors, each comprising a hue and an illuminative intensity. The colors that a display device is capable of displaying are collectively called the display device's color domain. As the size of a display device color domain grows, the amount of memory required to represent the color of one pixel increases because a sufficient number of bits must be allocated for encoding the illuminative intensity so as to distinguish among the available illuminative intensities. While the four antialiased character "A" of FIG. 1C requires only 2 bits per pixel to represent in a color domain of four illuminative intensity levels, the character requires 24 bits per pixel to represent in the color domain of 16,777,216 colors that is typical for modem display devices.

If a 2 bit per pixel antialiased character is to be displayed in a 16,777,216 color domain, the computer must translate the character's 2 bit per pixel representation into a 24 bit per pixel representation. This translation requires additional processing resources, and the 24 bit per pixel representation occupies 12 times as much space as the 2 bit per pixel representation. When the computer transmits the translated character to the display device, it must transmit 24 bits for each pixel of the character. Frequently used characters are often cached in memory associated with the display device. Because a limited amount of memory is available for this purpose, it must be used as efficiently as possible. If, at any point, the character is cached in the computer or the display device, 24 bits per pixel of cache memory must be devoted to the character.

While antialiased characters appear much less jagged than conventional characters, the extra memory consumption and transmission time that they require have inhibited their general use. Similar difficulties occur with the display of any image that uses a relatively small number of colors or shades on a monitor having a large color domain. For instance, color icons often use a small set of colors. FIG. 3 is a color diagram of a color icon. Color icon 300 is composed of a black color 301, a gray color 302, a brown color 303, a yellow color 304 and a white color 305. In any such case, the computer must translate each of the small number of colors into one of a much larger number of colors, whose representations consume larger amounts of memory. The larger representations must then be transmitted to the display device, and any image cache must store the larger representation.

SUMMARY OF THE INVENTION

The present invention provides a method and system for rapidly transmitting multicolor or gray scale display data having multiple bits per pixel to a display device. In a preferred embodiment, the method and system constitutes a software facility. The facility first encodes the image into multiple bit per pixel raster data. The multiple bit per pixel raster data has a number of pixels. Each pixel stores a color value corresponding to the color of a particular region within the image. The facility then associates one or more single bit per pixel raster planes with the multiple bit per pixel raster data. Each single bit per pixel raster plane corresponds to a color value that appears in the multiple bit per pixel raster data. Each pixel of each single bit per pixel raster plane corresponds to a pixel of the multiple bit per pixel raster data, and indicates whether the corresponding pixel in the multiple bit per pixel raster data contains the color value of the single bit per pixel raster plane. The facility then transmits the associated single bit per pixel raster planes to the display device. Each single bit per pixel raster plane is accompanied by one or more instructions to draw the single bit per pixel raster plane in the corresponding color value.

BRIEF DESCRIPTION OF THE DRAWINGS

FIG. 1A is a diagram that shows a conventional character bitmap for the character "A".

FIG. 2B is a multiple bit per pixel bitmap for the antialiased character shown in the display grid of FIG. 2A.

FIG. 6 is a diagram of the 2 bit per pixel data for the antialiased character "A" shown in FIG. 2B.

FIG. 8 is a diagram of the color value mapping table used by the facility.

FIG. 10A is a diagram of the single bit per pixel plane generated for the initial color value "3".

FIGS. 10B and 10C are diagrams of the single bit per pixel planes generated in the same manner for the initial color values "2" and "1," respectively.

DETAILED DESCRIPTION OF THE INVENTION

Figure 1B:
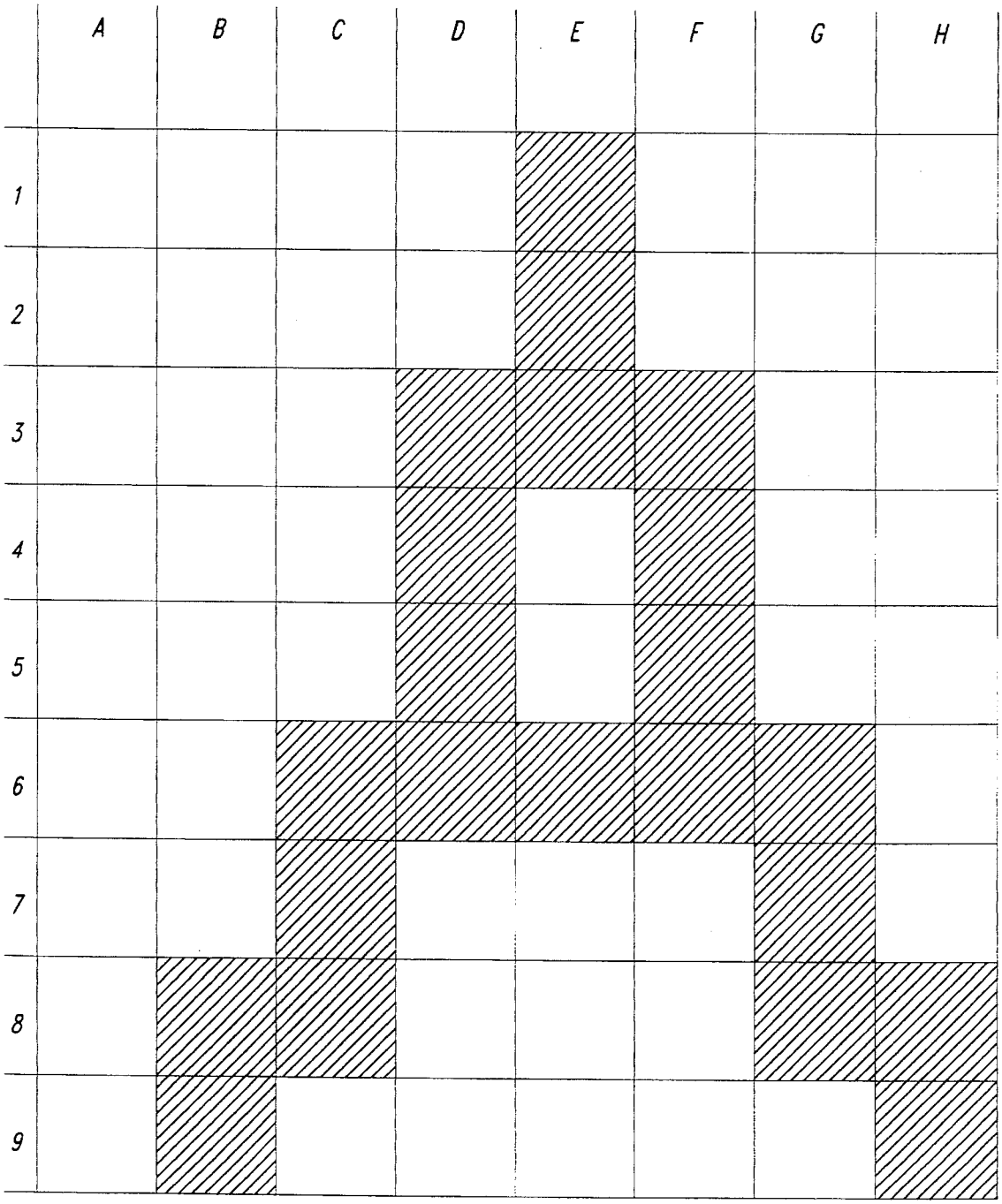
Fig. 1B (Prior Art)
FIG. 1B is a display grid for the bitmap shown in FIG. 1A.
Figure 1C:
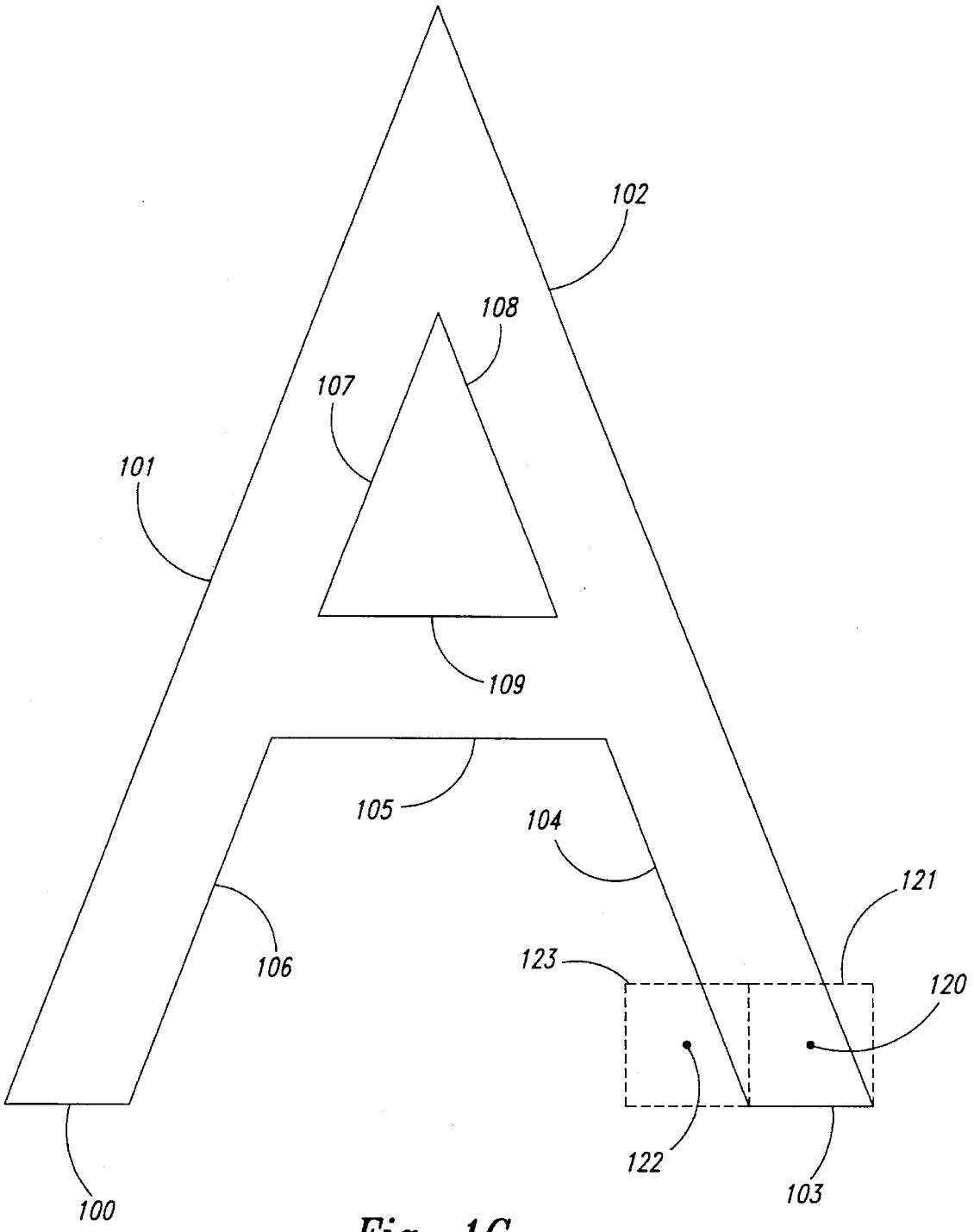
Fig. 1C (Prior Art)
FIG. 1C–D are diagrams that show a character outline for the character "A".
Figure 1D:
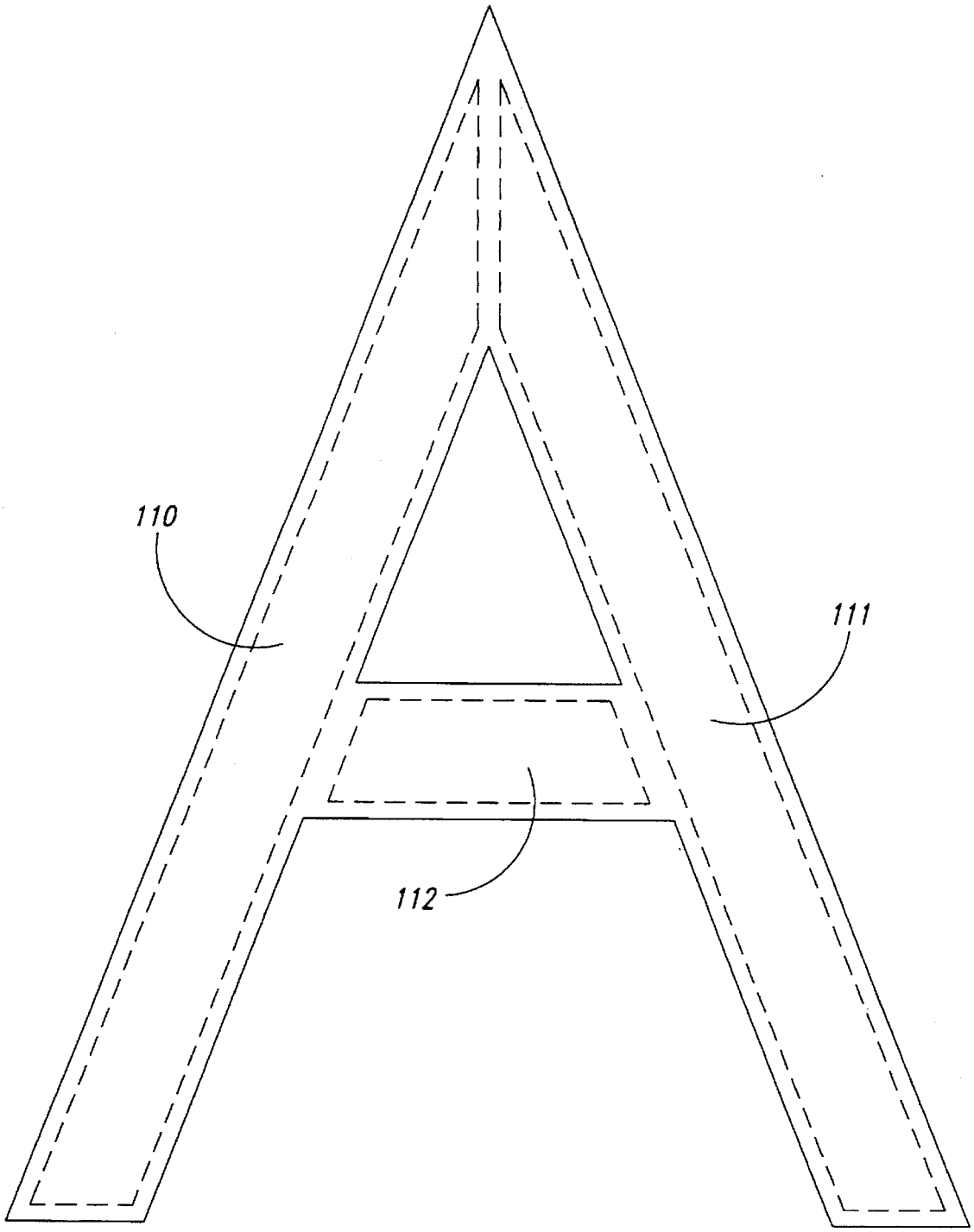
Fig. 1D (Prior Art)
Figure 1E:
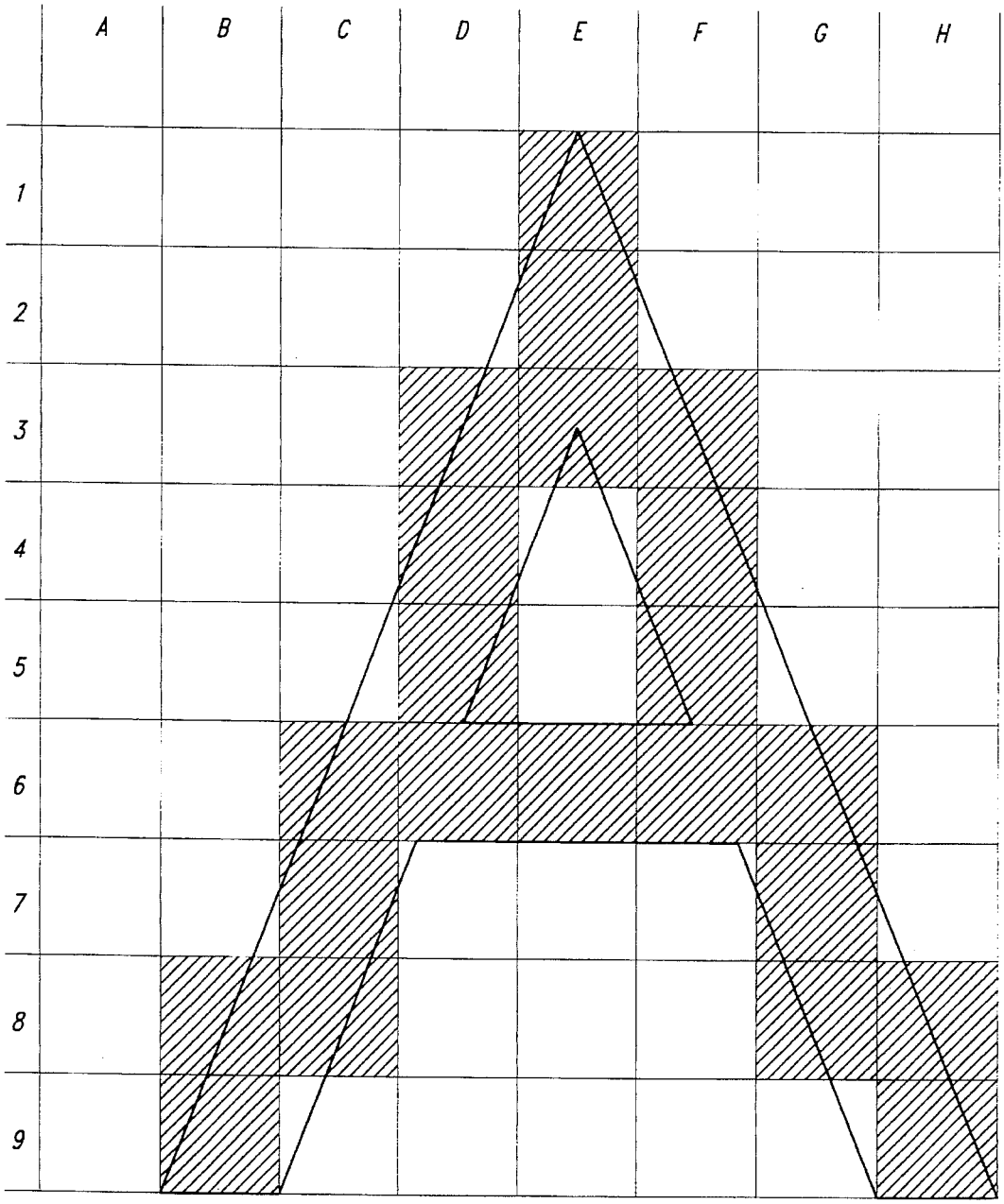
Fig. 1E (Prior Art)
FIG. 1E is a superimposition of a character outline over the display grid.
Figure 2A:
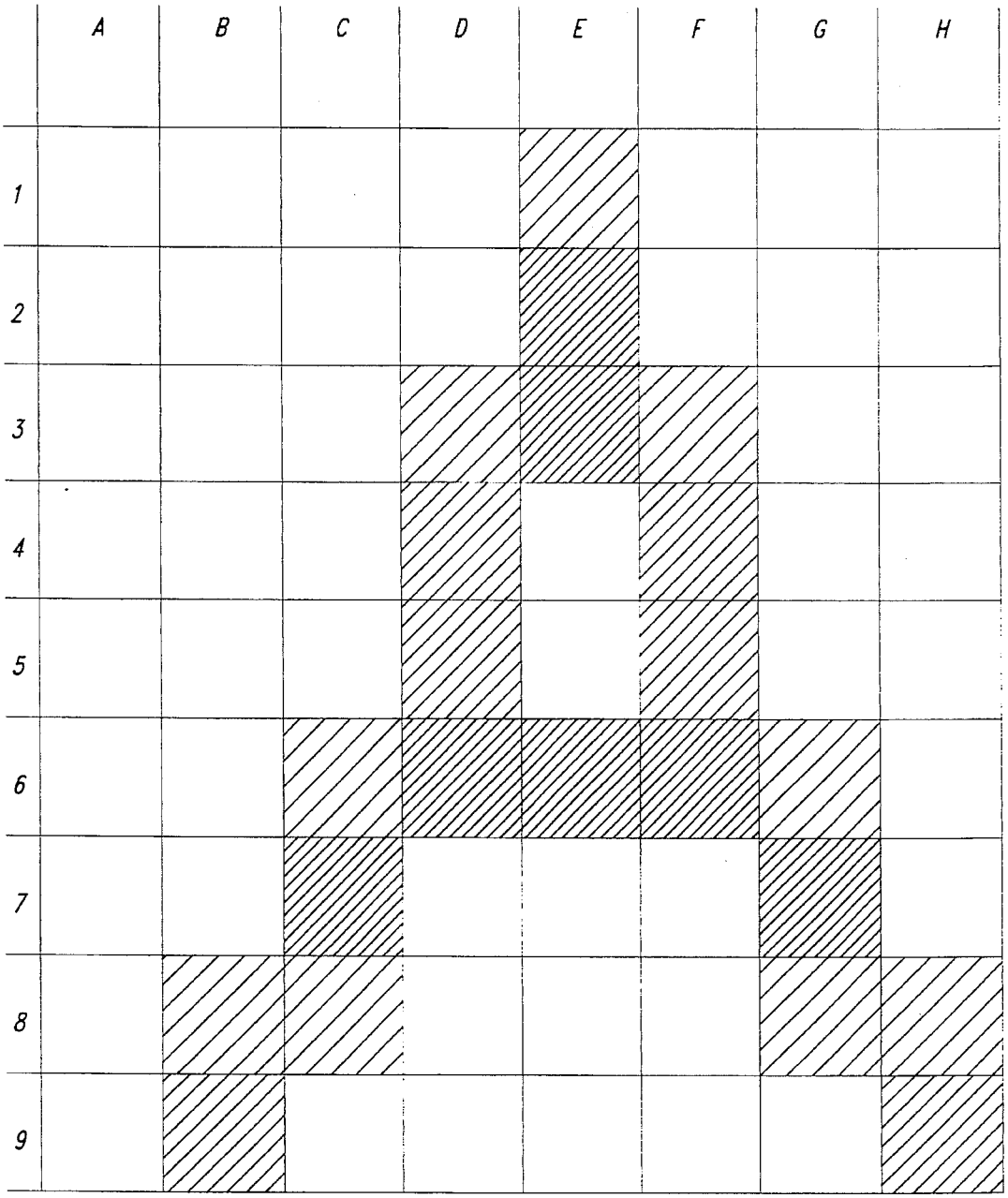
Fig. 2A (Prior Art)
FIG. 2A is a diagram that shows a display grid for an antialiased character bitmap for the character "A".
Figure 12A:
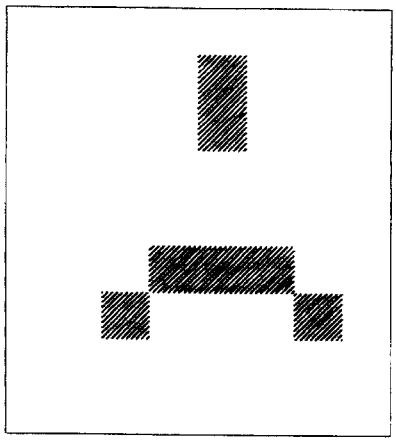
FIG. 12A shows the display of the plane having the most prominent display color value, here 0x000000.
Figure 12B:
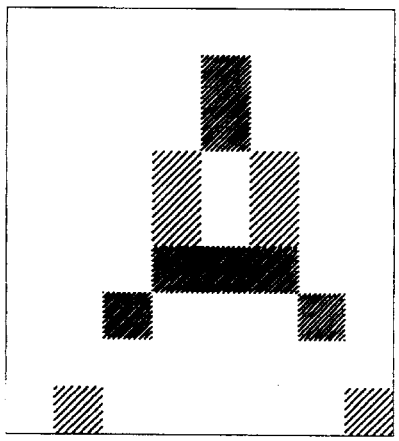
FIG. 12B shows the ensuing display of the plane for display color value 0x404040.
Figure 12C:
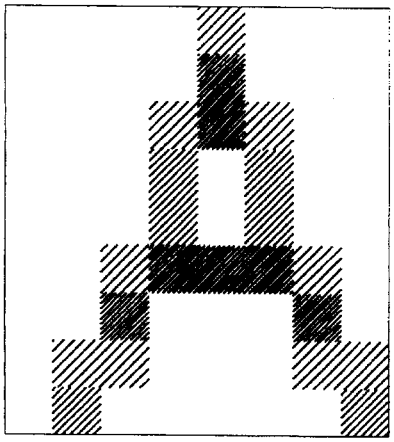
FIG. 12C shows the further display of the plane for display color value 0xA0A0A0.

A method and system is provided for efficiently transmitting the data for an image that uses a small number of colors or shades and can be encoded in a relatively small number of bits, such as an antialiased character as shown in FIG. 2A or a color icon, to a display device capable of displaying a large number of colors and can only be encoded in a relatively small number of bits. This permits a smaller volume of data to be transmitted than would be transmitted in the conventional manner, decreasing the time required for transmission. In a preferred embodiment of the present invention, a software facility maps each of the colors appearing in the data for the image into a color that the display device is capable of displaying, thereby creating a color value mapping table as shown in FIG. 8. The facility then generates a single bit per pixel raster data structure, called a plane, that specifies which pixels of the multiple bit per pixel raster data have a color value that has been mapped to that display color value. A plane is preferably stored as a two-dimensional array, also called a matrix. Examples of planes are shown in FIGS. 10A–10C. Finally, the facility transmits each plane to the display device with instructions to draw the image encoded by the plane in the display color of the plane, as shown in FIGS. 12A–12C.

Figure 4:
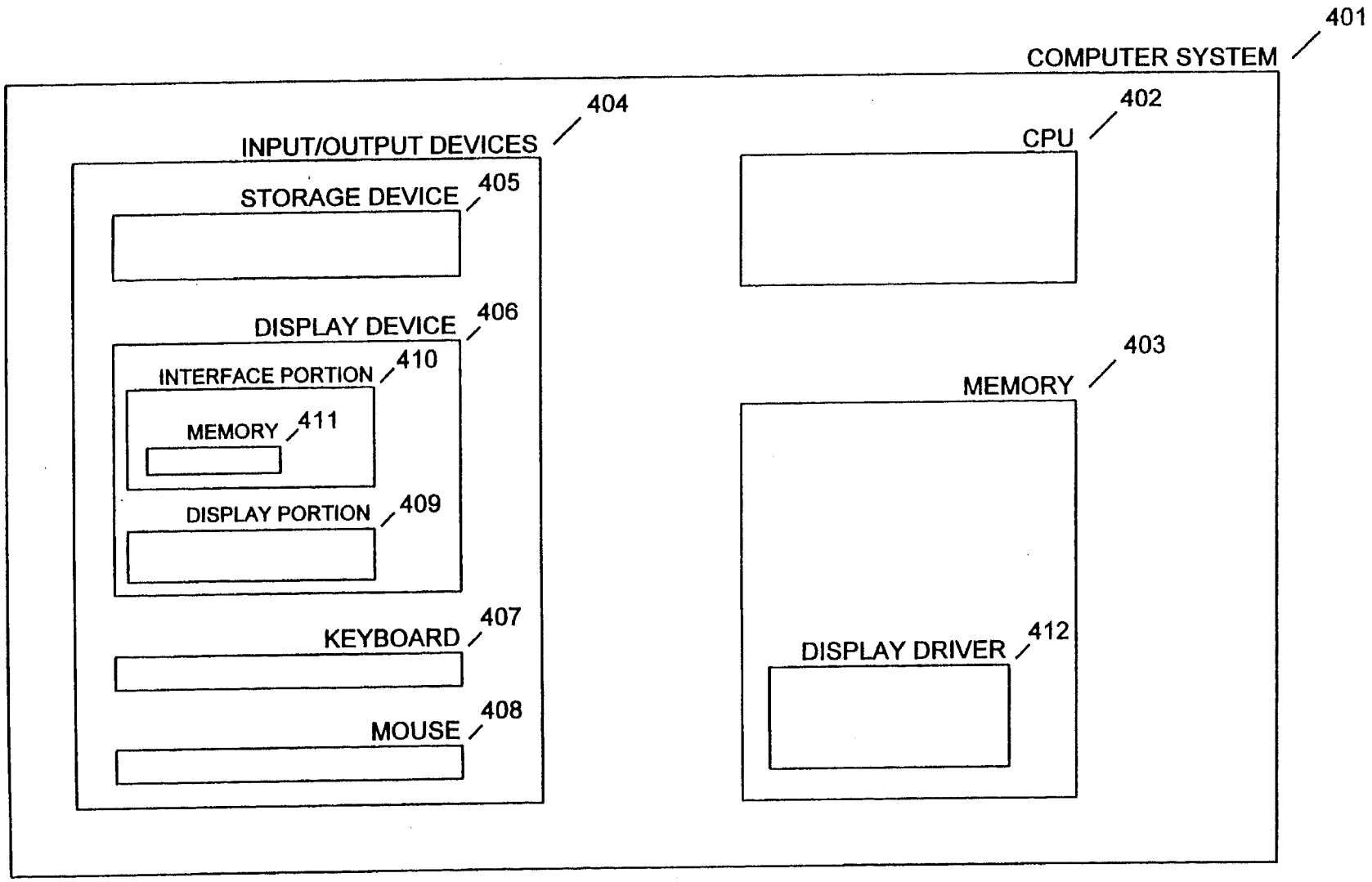
FIG. 4 is a high-level block diagram of the general-purpose computer system upon which the facility preferably operates.

FIG. 4 is a high-level block diagram of the general-purpose computer system upon which the facility preferably operates. The computer system 401 contains a central processing unit (CPU) 402, a computer memory (memory) 403, and input/output devices 404. The computer programs that preferably control the actions of the facility reside in the memory 403 and execute on the CPU 402. Among the input/output devices 404 are a storage device 405, such as a hard disk drive, and a display device 406. The input/output devices 404 further include a keyboard 407 and a mouse 408 for receiving input from a user. The facility preferably displays antialiased characters and other images on the display device 406. The display device 406 preferably includes a display portion 409 for actually displaying pixels and an interface portion 410 for receiving display instructions and data from the computer system 401. The computer system preferably interacts with the interface portion 410 using a display driver program ("display driver") 412, which translates display instructions from a graphics device interface program ("GDI") 413 to a device-specific form that can be understood by the particular display device. The code for the facility can be contained in either the display driver or the GDI where the facility caches planes. Within the display device, code for the facility must be contained within the display driver, as this is the only program that is capable of interacting directly with the display device. If no caching within the display device is performed, the code for the facility is preferably contained in the display driver in which the code for the facility is preferably contained.

In its preferred form, the interface portion 410 of the display device is known as a display adapter. Display adapters like that found in the interface portion 410 are well known in the art and process instructions to draw points, lines, boxes and other shapes in any color or colors that the display portion is capable of displaying. These colors are designated by display color values, which must contain at least as many bits as is required to distinguish between them. Display adapters also almost universally support a monochrome mask feature for quickly displaying a single bit per pixel bitmap in a single color. When this feature is used in the adapter's transparent mode, the adapter in interface portion 410 changes any pixels having a one in the bitmap to the color specified and does not change any pixels having a zero in the bitmap. The group of pixels having a one in the bitmap are known collectively as the "mask." In a preferred embodiment, the facility uses the monochrome mask feature to quickly display each plane that it generates.

Most display adapters contain memory 411. A portion of the display adapter memory 411, known as the "display content memory," is used to hold the data for the image currently being displayed. The data specifies the color value of each of the display's pixels. The remainder of the display adapter memory 411 can be used to hold display data that is not currently being displayed, but that may quickly be copied into the display content memory in order to display it. This technique is known as "caching" display data.

Figure 5:
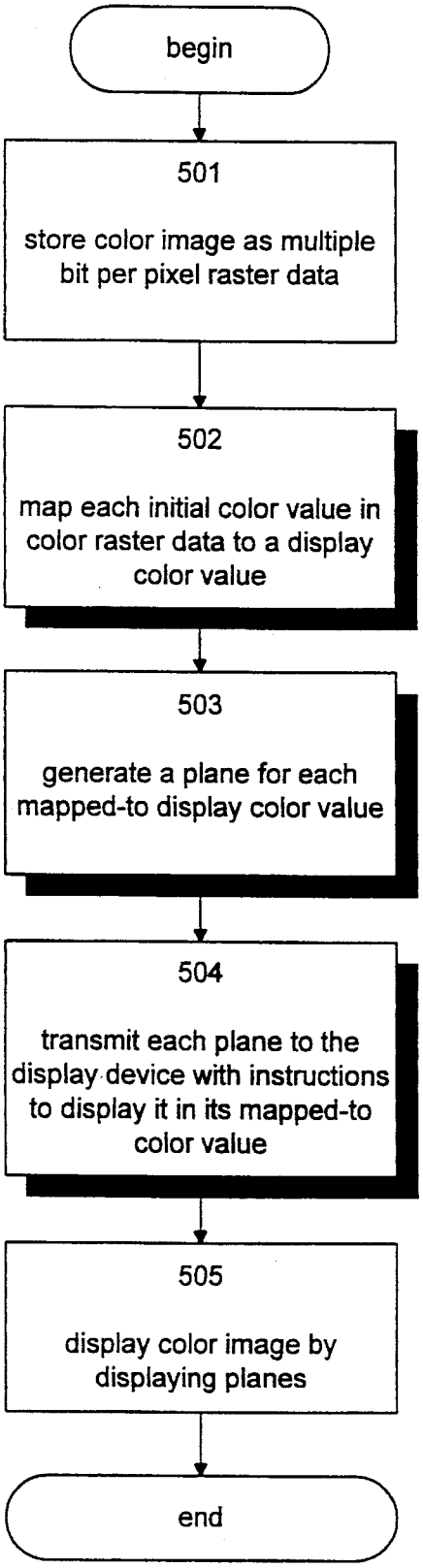
FIG. 5 is an overview flow diagram of the operation of the facility.

FIG. 5 is an overview flow diagram of the operation of the facility. In step 501, the facility stores in memory 403 (FIG. 4) a color image as multiple bit per pixel raster data, wherein the color of each pixel is encoded in a multiple bit color value. These color values are known collectively as the initial color values. The color image stored in step 501 is deemed to include an image in a single hue but differing illuminative intensities, such as a character of an antialiased font. Once the facility stores the color image as multiple bit per pixel raster data, it may be further manipulated by the user. For example, the multiple bit per pixel raster data can be copied and transported to different computers. The multiple bit per pixel raster data may also be edited to change the appearance when displayed.

As an example of multiple bit per pixel raster data, FIG. 6 is a diagram of the 2 bit per pixel data for the antialiased character "A" shown in FIG. 2B. Each color value corresponds to a pixel of the character. For example, the color value "2" in the lower right hand comer of the 2-bit per pixel raster data corresponds to the shade of pixel H9 (FIG. 2B).

At a later time, in response to a display request from the user, in step 502, the facility maps each color value in the multiple bit per pixel raster data stored in step 501 (initial color value) to an appropriate color value for display by the display device (display color value). The display color value is chosen either to match the intended colors for the multiple bit per pixel raster data as closely as possible, or to optimize for particular characteristics of the display device. Further detail on this step is presented in FIG. 7.

In step 503, for each display color value to which an initial color value appearing in the multiple bit per pixel raster data was mapped in step 502, the facility generates a plane that specifies which pixels of the multiple bit per pixel raster data have an initial color value that has been mapped to that display color value.

In step 504, the facility transmits each plane to the display device with instructions to display it in its display color value. In step 505, the display device displays the color image by displaying each of the planes transmitted in step 504 in its mapped-to display color value. The facility then concludes.

Figure 7:
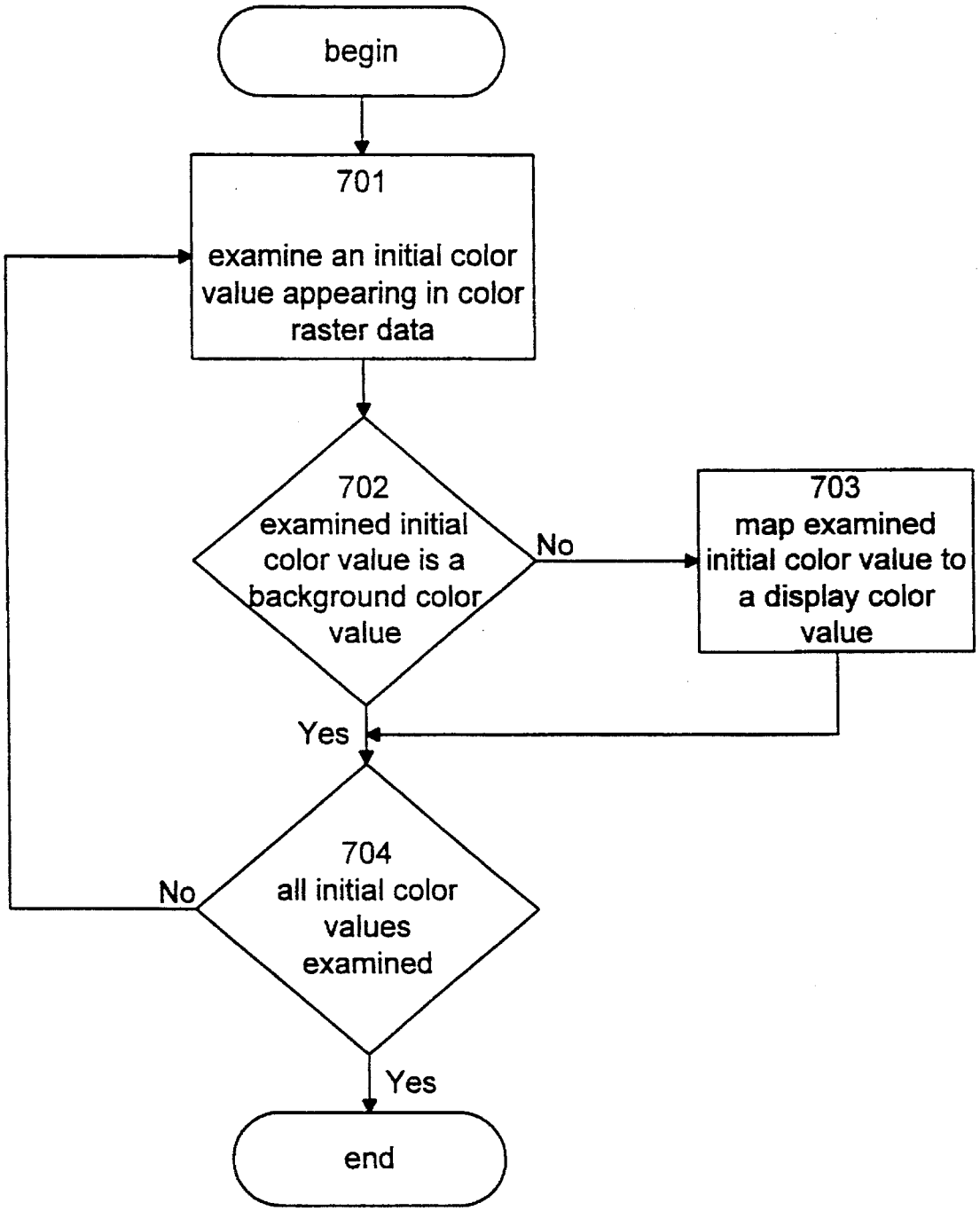
FIG. 7 is a flow diagram describing step 502 for initial color mapping in greater detail.

FIG. 7 is a flow diagram describing step 502 for initial color mapping in greater detail. In steps 701–704, the facility maps each initial color value appearing in the color raster data to a display color value that the display device 406 (FIG. 4) is able to display. In step 701, the facility examines an initial color value that appears in the color raster data. In a preferred embodiment, some initial color values appearing in the color raster data are defined as background color values. A background color value is one that is used to portray an image's context or surroundings instead of the image itself. For example, the unshaded pixels of the antialiased character shown in FIG. 2A are each assigned a background color value. In step 702, if the examined initial color value is a background color value, then the facility continues at step 704, else the facility continues at step 703. The color raster data for some images contains no background color values. In such a case, the facility always executes step 703.

In step 703, the facility maps the examined initial color value to an appropriate display color value that can be displayed on the display device 406 (FIG. 4). In some cases, the examined initial color value may be mapped to the same display color value as some other examined initial color value. This has the beneficial effect of reducing the number of planes that the facility must generate and transmit in steps 503 and 504, respectively, of FIG. 5. Step 703 preferably adds an entry to a color value mapping table stored in the memory 403 (FIG. 4). Each entry contains an initial color value appearing in the color raster data and the display color value to which the initial color value has been mapped.

Several different preferred strategies exist for the color mapping performed in step 703. In a first strategy, the facility attempts to match display colors to initial colors as faithfully as possible. In a second strategy, the facility attempts to map from initial colors to display colors in such a way that the final image, when displayed on the display device, will be optimized for particular characteristics of the display device. For instance, the optimal color mapping for a monochrome display device would be much different than the optimal mapping for a multicolored device.

FIG. 8 is a diagram of the color value mapping table used by the facility. The table 801 is comprised of horizontal rows called entries. Each entry contains two color values. The first value is an initial color value that appears in the multiple bit per pixel raster data. The second data is the display color value to which the facility has mapped the initial color value. For example, the facility has mapped initial color value 3 to display color value 0x000000. Other initial colors are similarly mapped. In a preferred embodiment, background color values, such as the value zero in the multiple bit per pixel raster data shown in FIG. 5, are not mapped to any display color, thereby saving the computing resources that would have been required to do the mapping.

After the facility maps the examined initial color value to the display color value, in step 704, if all of the initial color values appearing in the color raster data have been examined, then the processing illustrated in FIG. 7 concludes, else the facility continues at step 701 to examine another initial color value for mapping. In some cases, the multiple bit per pixel raster data stored in step 501 may already contain only appropriate color values that may be displayed by the display device. In such a case, no mapping is necessary. Alternatively, each of these color values can be mapped to itself.

Figure 9:
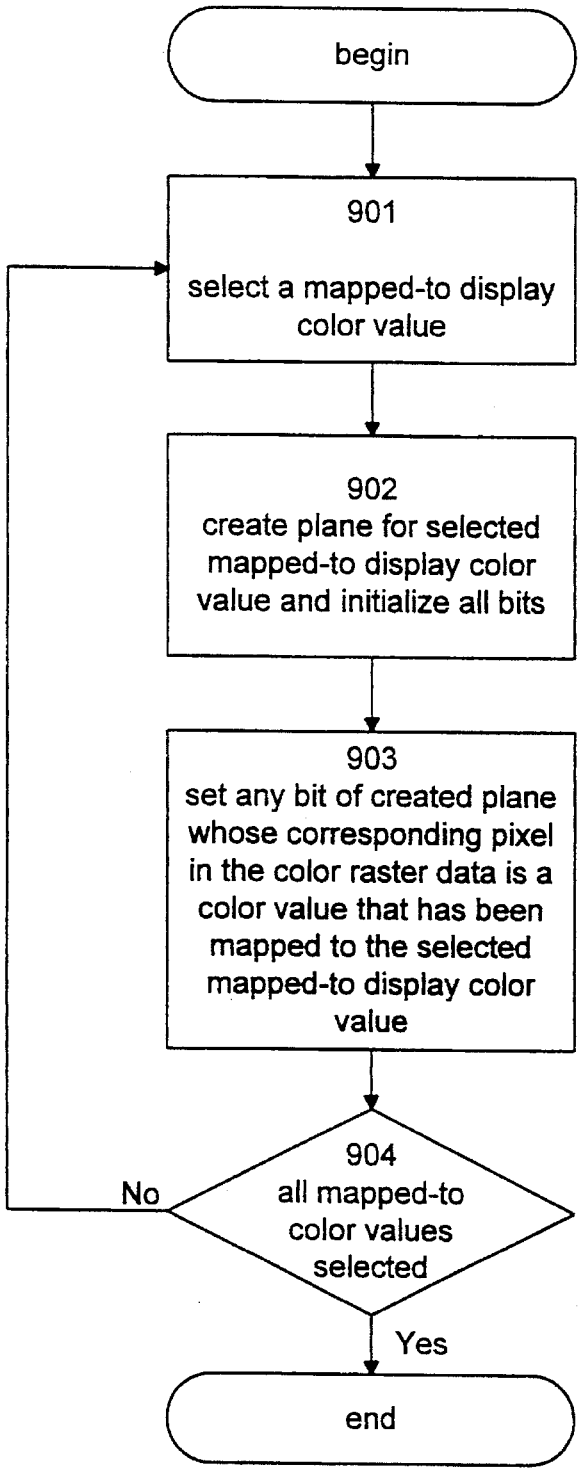
FIG. 9 is a flow diagram describing step 503 for generating planes in greater detail.

FIG. 9 is a flow diagram describing step 503 for generating planes in greater detail. In steps 901–904, the facility generates the single bit per pixel planes that will be transmitted to and displayed on the display device. In step 901, the facility selects a display color value to which one or more initial color values have been mapped. In step 902, the facility creates a plane for the selected display color value and initializes all pixels. This involves reserving memory for the plane in the memory 403 (FIG. 4) and setting each bit of the plane to zero. In step 903, the facility sets to one selected bits of the plane that was created and initialized in step 902. The facility sets to one the bit corresponding to any pixel in the multiple bit per pixel raster data having an initial color value that has been mapped to the display color value of the plane. In step 904, if all of the display colors that have been mapped to have been selected, then the processing illustrated in FIG. 9 concludes, else the facility continues at step 901 to select another display color value to which one or more initial color values have been mapped.

FIGS. 10A–C are diagrams of the single bit per pixel planes generated by the facility for the antialiased character "A" shown in FIG. 2A. FIG. 10A is a diagram of the single bit per pixel plane generated for the initial color value "3". For each pixel, its value is one if the corresponding pixel of the 2 bit per pixel data is a "3" and zero if the corresponding pixel of the 2 bit per pixel data is not a "3". FIGS. 10B and 10C are diagrams of the single bit per pixel planes generated in the same manner for the initial color values "2" and "1," respectively.

Figure 11:
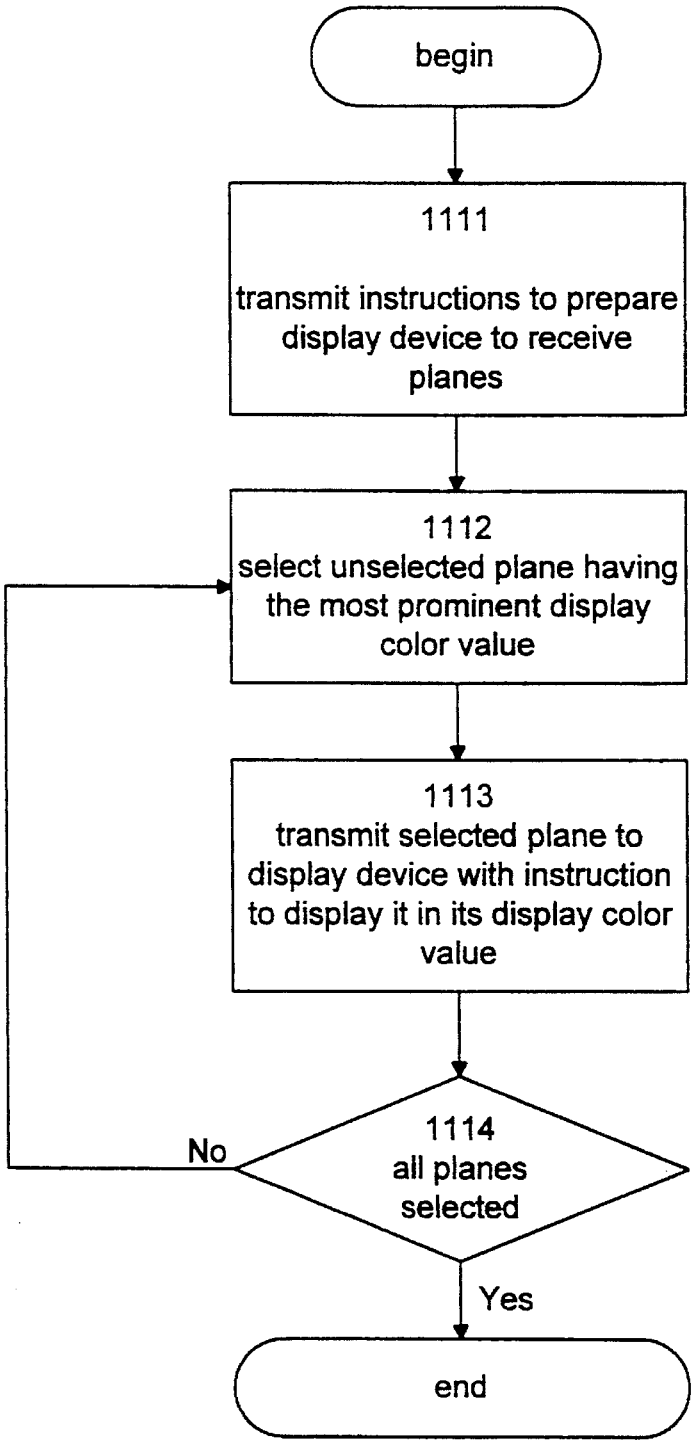
FIG. 11 is a flow diagram describing step 504 for transmitting planes in greater detail.

FIG. 11 is a flow diagram describing step 504 for transmitting planes in greater detail. In steps 1101–1103, the facility transmits the planes generated in step 503 to the display device 406 (FIG. 4) via its interface portion 410 (FIG. 4). In step 1101, the facility transmits to the display device 406 (FIG. 4) via its interface portion 410 (FIG. 4) instructions to prepare the display device for receiving the planes. A sample of the instructions required to prepare display adapters that use an S3, Inc. 86C911 Graphical User Interface Accelerator chip to receive the planes appears in Code Block 1 below. These instructions, like those for other graphics chips, proceed by loading particular values into various registers associated with the chip.

CODE BLOCK 1

```
1   *pMULTIFUNC_CNTL = 0xA080;
2   *pRWIDTH_REG = width − 1;
3   *pRHEIGHT_REG = height − 1;
4   *pCMD_REG = 0x5333;
5   *pBKGD_MIX_REG = 0x0007;
6   *pFGD_MIX_REG = 0x0027;
```

Code Block 1 contains the instructions required to prepare the display adapter to receive the planes. These instructions are executed once, before any of the planes are transmitted. Line 1 of the instructions loads a value into the multifunction control register that instructs the graphics adapter to process image data in its received form, instead of expanding packed data. Lines 2 and 3 of the instructions set the width and height, respectively, of the rectangle in which the planes are to be drawn by loading those values into the rectangle horizontal width and rectangle horizontal height registers, respectively. Line 4 loads a value into the command register that places the display adapter in the correct mode to display a single bit plane in a single color. Lines 5 and 6 load values into the foreground and background color mixture registers that instruct the display adapter to draw the planes transparently; that is, when drawing a particular plane, when a bit in the plane is on, setting the corresponding pixel to the value stored in the foreground color register, and when a bit in the plane is a zero, leaving the corresponding pixel unchanged.

After the facility transmits to the display device 406 (FIG. 4) instructions to prepare the display device for receiving the planes, in step 1102, the facility selects a plane for transmission. The facility preferably selects the plane having the most prominent display color that has not yet been selected. One display color is said to be more prominent than another if it is more readily visible to a user. For example, when displaying black and gray antialiased characters against a white background, the most prominent display color is the darkest color, i.e., black.

In step 1103, the facility transmits the selected plane to the display device 406 (FIG. 4) via the interface portion 410 (FIG. 4).

CODE BLOCK 2

```
11   *pFRGRD_COLOR_REG = DisplayColor;
12   *pCUR_X = x;
13   *pCUR_Y = y;
14   for (byte = 0; byte < LastByte; byte++)
15     *pPIX_TRANS_REG = PlaneData[byte];
```

Code Block 2 contains the instructions for drawing a single plane using the S3 chip. These steps are repeated for each generated plane. If it is desired to draw the image opaquely, that is, filling in a background color, then the plane drawing code should be preceded by well-known code to first draw a rectangle in the desired background color. Line 11 of the instructions sets the foreground color of the graphics adapter, stored in the foreground color register, to the display color value for the plane to be transmitted. Lines 12 and 13 of the instructions set the horizontal and vertical coordinates, respectively, of the point at which the upper left-hand corner of the plane is to be drawn by loading those values into the current x position and current y position registers. Lines 14 and 15 are a loop that transmits the contents of the plane to the display for drawing by repeatedly loading bytes of the plane data into the pixel transfer register. The contents are transmitted one byte at a time. Data for the plane may also be transmitted in different increments. Until enough plane data has been transmitted to fill the rectangle defined in lines 2 and 3, the instructions continue to load bytes of the plane data into the pixel transfer register. The pixels corresponding to the bits contained in each byte are drawn as each byte is received.

In step 1104, if all the generated planes have been selected, then the processing illustrated in FIG. 11 concludes, else the facility continues at step 1102 to select the next most prominent display color that has not yet been selected.

The above code blocks are optimized for graphics adapters in which the instructions on lines 2 and 3, altering the width and height of the line rectangle, take a significant amount of time. For that reason, a standard plane width and height are chosen, and each plane has the same dimensions, so that the drawing rectangle width and height only need be set once. However, in some display adapters these instructions can be processed very quickly. In a preferred embodiment, when the display adapter is one that can process these instructions quickly, the size of each plane is independently determined by removing all of the exterior rows and columns that contain no bits with the value one. In this embodiment, the dimensions of each plane are stored separately. Further, lines 5 and 6 are moved into code block 2, so that they are executed separately for each plane. Also, each plane's individual width and height is used instead of a standard width and height for all planes.

In a preferred embodiment, when the display adapter has sufficient memory 411 (FIG. 4), planes that are likely to be redisplayed later, instead of being written directly to display content memory as shown in the above code blocks, can be cached in display adapter memory outside of display content memory. Since most display adapters can quickly copy data to display content memory from other display adapter memory, the planes can be quickly displayed after first being cached. The cached planes may then later be redisplayed with the same speed, exploiting the quick memory move feature of the display adapter.

FIGS. 12A–C are display diagrams showing how the antialiased letter "A" whose single bit per pixel planes are shown in FIGS. 10A–C is displayed on a display device. FIG. 12A shows the display of the plane having the most prominent display color value, here 0x000000. By displaying this part of the character first, the facility is able to present a visually significant part of the character to the user immediately. FIG. 12B shows the ensuing display of the plane for display color value 0x404040. At this point, most of the character has been presented to the user. FIG. 12C shows the further display of the plane for display color value 0xA0A0A0. The display of this plane completes the character.

Figure 3:
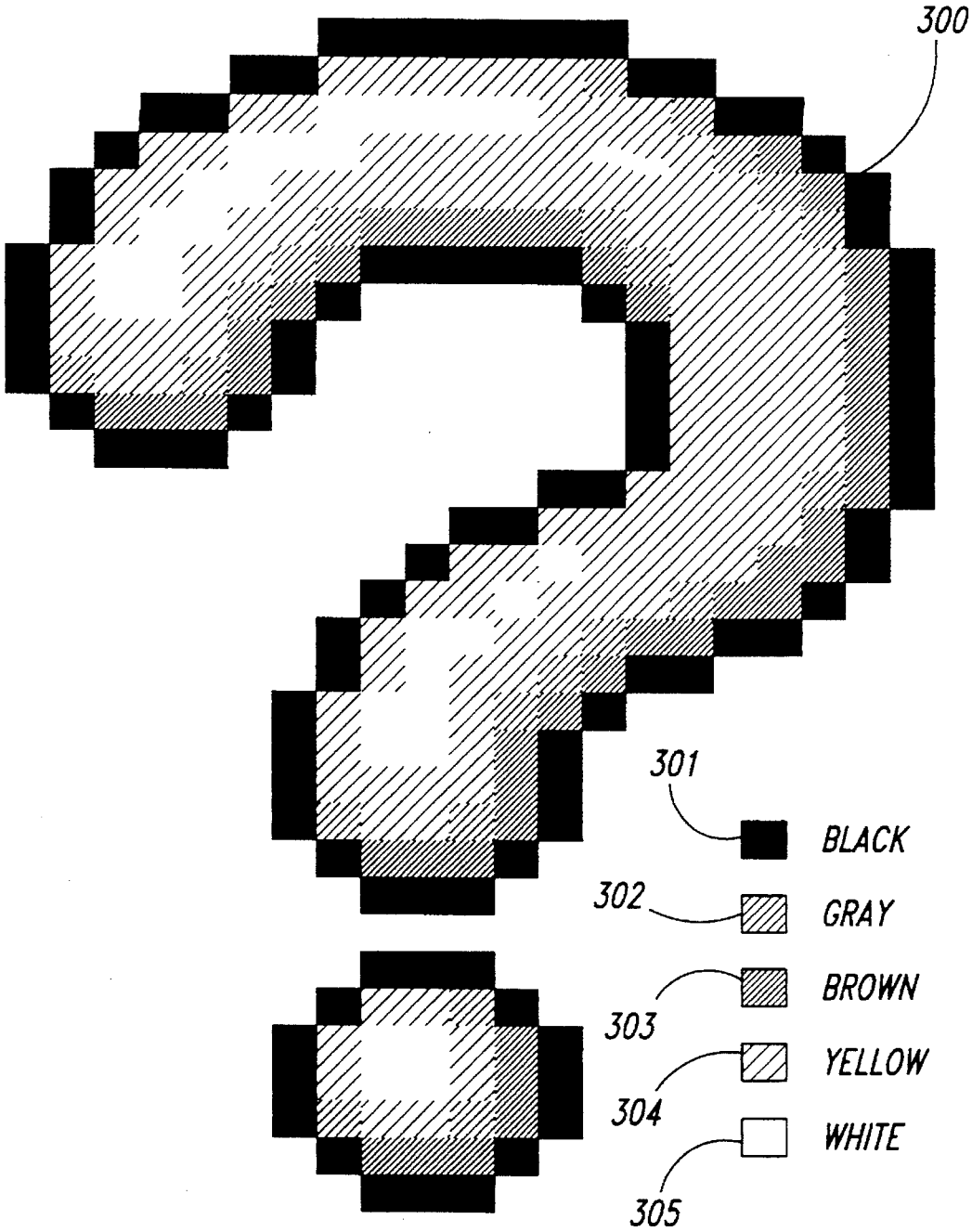
Fig. 3 (Prior Art)
FIG. 3 is a color diagram of a color icon.

The facility operates in the same manner to transmit a color icon like the one shown in FIG. 3 to the display device. In step 501 (FIG. 5), the facility stores the color icon 300 (FIG. 3) as multiple bit pixel raster data, wherein the color of each pixel of the icon is encoded in a multiple bit color value. The colors that these color values represent are shown as color 301, 302, 303, 304 and 305. In step 502, the facility maps each color value in the multiple bit per pixel raster data for the icon to an appropriate color value for display by the display device. As an example, the facility would seek to map the brown color 303 (FIG. 3) to a display color value that appears to be brown on the display portion of the display device. In step 502, the facility preferably generates a color value mapping table similar to the one shown in FIG. 8. In step 503, for each display color value to which an initial color value appearing in the multiple bit per pixel raster data was mapped, the facility generates a plane that specifies which pixels of the multiple bit per pixel raster data have an initial color value that has been mapped to that display color value. In step 504, the facility transmits each plane to the display device with instructions to display it in its display color value.

While this invention has been shown and described with reference to preferred embodiments, it will be understood by those skilled in the art that various changes or modifications in form and detail may be made without departing from the scope of the invention. For example, steps 503 and 504 could be combined to implement "on-the-fly" plane generation, wherein a first plane is generated then transmitted, after which a second plane is generated and transmitted, and so forth. Also, instead of being implemented as software, the facility could be stored in read-only memory as firmware, or even implemented as a combinatorial logic network.

We claim:

1. A method in a computer system having a display device for displaying an element of an antialiased font, the antialiased font element having pixels of more than two initial levels of illuminative intensity, comprising the steps of:

mapping one or more different selected initial levels of illuminative intensity of the pixels of the antialiased font element exclusively to each of a selected plurality of display levels of illuminative intensity of the display device;

for each of the selected plurality of display levels of illuminative intensity to which an initial level of illuminative intensity is mapped, generating a separate matrix indicating which pixels of the antialiased font element have initial levels of illuminative intensity that have been mapped to that selected display level of illuminative intensity; and for each selected display level of illuminative intensity for which a matrix is generated, in the order of the most visually prominent level of illuminative intensity to the least visually prominent level of illuminative intensity, displaying on the display device at the selected display level of illuminative intensity the pixels indicated by the matrix, such that the pixels indicated by all of the matrices are displayed simultaneously in their respective display levels of illuminative intensity to display the antialiased font element.

2. The method of claim 1 wherein the step of mapping includes the step of generating a mapping table containing entries, each of the entries containing one of the initial levels of illuminative intensity and the display level of illuminative intensity to which the initial level of illuminative intensity is mapped in the mapping step, and wherein the step of generating a matrix generates one matrix for each mapped-to display level of illuminative intensity appearing in the mapping table.

3. The method of claim 1 wherein the step of mapping maps each initial mapped-to level of illuminative intensity to substantially the same display level of illuminative intensity.

4. The method of claim 1 wherein the step of mapping maps a plurality of initial mapped-to levels of illuminative intensity to the same display level of illuminative intensity.

5. The method of claim 1 wherein the step of mapping is performed in such a way as to optimize the appearance of the element of an antialiased font on the display device.

6. The method of claim 2 wherein the selected display levels of illuminative intensity in which the pixels indicated by the matrices are displayed by the displaying step are each a shade of gray.

7. A computer-readable medium whose contests cause a computer system to display an element of an antialiased font, the antialiased font element having pixels of more than two initial levels of illuminative intensity, to comprise:

a mapping subsystem for mapping one or more different selected initial levels of illuminative intensity of the pixels of the antialiased font element exclusively to each of a selected plurality of display levels of illuminative intensity of the display device;

a matrix generator for, for each of the selected plurality of display levels of illuminative intensity to which an initial level of illuminative intensity is mapped, generating a separate matrix indicating which pixels of the antialiased font element have initial levels of illuminative intensity that have been mapped to that selected display level of illuminative intensity; and a display device for, for each selected display level of illuminative intensity for which a matrix is generated, in the order of the most visually prominent level of illuminative intensity to the least visually prominent level of illuminative intensity, displaying at the selected display level of illuminative intensity the pixels indicated by the matrix, such that the pixels indicated by all of the matrices are displayed simultaneously in their objective display levels of illuminative intensity to display the antialiased font element.

8. The computer-readable medium of claim 7 wherein the mapping subsystem generates a mapping table containing entries, each of the entries containing one of the initial levels of illuminative intensity and the display level of illuminative intensity to which the initial level of illuminative intensity is mapped by the mapping subsystem, and wherein the matrix generator generates one matrix for each mapped-to display level of illuminative intensity appearing in the mapping table.

9. The computer-readable medium of claim 7 wherein the mapping subsystem maps each initial mapped-to level of illuminative intensity to substantially the same display level of illuminative intensity.

10. The computer-readable medium of claim 7 wherein the mapping subsystem maps a plurality of initial mapped-to levels of illuminative intensity to the same display level of illuminative intensity.

11. The computer-readable medium of claim 7 wherein the mapping subsystem is performed in such a way as to optimize the appearance of the element of an antialiased font on the display device.

12. The computer-readable medium of claim 7 wherein the selected display levels of illuminative intensity in which the display device displays the pixels indicated by the matrices are each a shade of gray.

* * * * *

UNITED STATES PATENT AND TRADEMARK OFFICE

CERTIFICATE OF CORRECTION

PATENT NO. : 5,565,886
DATED : October 15, 1996
INVENTOR(S) : Michael S. Gibson

It is certified that error appears in the above-indentified patent and that said Letters Patent is hereby corrected as shown below:

In column 11, claim 7, line 8, please delete "contests" and insert therefor --contents--.

Signed and Sealed this

Twenty-ninth Day of April, 1997

*Attest:*

Bruce Lehman

BRUCE LEHMAN

*Attesting Officer*

*Commissioner of Patents and Trademarks*